United States Patent [19]

Osborn et al.

[11] Patent Number: 4,819,928

[45] Date of Patent: Apr. 11, 1989

[54] PLASTIC FILM AIR TABLE CONVEYOR

[75] Inventors: Paul V. Osborn, Webster, N.Y.; Clyde C. Tendick, Jacksonville, Ill.

[73] Assignee: Mobil Oil Corporation, New York, N.Y.

[21] Appl. No.: 99,275

[22] Filed: Sep. 21, 1987

[51] Int. Cl.[4] ..... B65H 5/22

[52] U.S. Cl. ..... 271/276; 271/193; 271/195; 271/197

[58] Field of Search ..... 271/276, 195, 196, 197, 271/193

[56] References Cited

U.S. PATENT DOCUMENTS

| | | | |
|---|---|---|---|
| 3,123,354 | 3/1964 | Ungerer | 271/197 |
| 3,477,558 | 11/1969 | Fleischauer | 271/197 X |
| 3,805,683 | 4/1974 | Hook | 271/197 X |
| 4,275,977 | 6/1981 | Joice | 271/197 X |
| 4,526,357 | 7/1985 | Kuehnle | 271/193 X |

*Primary Examiner*—Richard A. Schacher
*Attorney, Agent, or Firm*—Alexander J. McKillop; Charles J. Speciale

[57] ABSTRACT

A plastic film handling apparatus includes an air table formed by a box having a surface crossed by a conveyor, in the form of endless belts surrounding the box, in which a multiplicity of individual air chambers is provided. Each of the individual chambers is selectively pressurized (negative or positive) by selective coupling of the chambers with a blower through a manifold chamber. Openings through the surface couple each chamber with an overlying plastic film. A second blower and manifold chamber, selectively coupled with the individual chambers, is provided so that at least two air pressure levels, different from atmospheric and one another, can be generated. The air manifold chambers are isolated from one another adjoining each of the individual air chambers and are selectively coupled with individual chambers by the removable gates therebetween or by the setting of other conventional settable air couplings between the individual chambers and each manifold chamber. A static bar is provided to apply a static electric charge to the plastic film to attract the film to the conveyor and hold the film in place in the absence of suction.

13 Claims, 3 Drawing Sheets

PLASTIC FILM AIR TABLE CONVEYOR

FIELD OF THE INVENTION

The invention relates to plastic film handling apparatus and, in particular, to an air table conveyor adapted for handling plastic films of different sizes.

BACKGROUND OF THE INVENTION

Vacuum table conveyors are well known where a substantially uniform vacuum is applied across the entire surface of the table through a multiplicity of small, regularly spaced openings. A major drawback of such tables is their lack of versatility. It may be difficult or impossible to apply a sufficiently satisfactory vacuum to a plastic film web to be conveyed across the table, if the web is so small that significant numbers of the vacuum openings through the table are exposed. Alternatively, it may be difficult to develop or maintain a substantially uniform vacuum between an edge of such a web, near a large number of exposed vacuum opening and a center portion of the web, surrounded by covered openings.

It would therefore be beneficial to provide an air table conveyor capable of being used with plastic film webs of differing sizes.

It would also be advantageous, in certain situations, to be able to apply different air pressures at different locations such as a first, higher vacuum, where the conveyor initially receives the film from an adjoining feeder, and a lower vacuum where the film is removed from the conveyor.

Alternatively, it would be advantageous to be able to apply a greater vacuum near the edges of a plastic film on such a conveyor and a lesser vacuum on the center of the plastic film to reduce loading on the conveyor.

It would also be advantageous to be able to apply positive and/or negative air pressures to selected areas of such a conveyor. Positive air pressure refers to a pressure greater than one atmosphere while negative air pressure is one less than one atmosphere (i.e. vacuum).

It would also be advantageous to be able to hold the film on the conveyor by vacuum and/or electrostatic attraction.

SUMMARY OF THE INVENTION

An object of the invention is to provide a plastic film handling apparatus in which a selected air pressure can be selectively applied to particular areas of the apparatus.

It is also an object of the invention to provide a plastic film handling apparatus in which different levels of positive and/or negative air pressure and/or a static electric charge can be applied to the film at different areas of the apparatus.

A plastic film handling apparatus of the invention comprises a conveyor for moving the film across a surface having a plurality of individual air chambers adjoining the other side of the surface opposite the conveyor. A plurality of regularly spaced openings extend through the surface into the plurality of individual air chambers. A pressurizing system is provided for applying a first air pressure level different from atmospheric air pressure to only a first selected number of the individual air chambers.

According to another aspect of the invention, the pressurizing system also simultaneously applies a second air pressure level different from the first and different from atmospheric to a different selected number of the multiplicity of individual air chambers.

In an exemplary construction, a horizontal air table conveyor is provided by an air box and a continuous conveyor encircling the air box. A plurality of interconnected, air-tight partitions within the box define a plurality of adjoining individual isolated air chambers. A plurality of openings extend through one side of the air box into the plurality of individual isolated air chambers. An air pressurizing source simultaneously applies a first air pressure level to a first selected number of the individual chambers and a second air pressure level different from the first air pressure level and from atmospheric air pressure to a different, second selected number of the plurality of individual air chambers. In accordance with a further aspect of the invention, electrostatic means extends over the conveyor intermediate the ends thereof for applying a static electric charge to a length of plastic film being conveyed on the conveyor.

According to another aspect of the invention, each of the individual air chambers adjoins two separate, isolated air manifold chambers formed within the box. The individual air chambers are parallel and elongated in the direction of movement of the conveyor. Each of the two air manifold chambers extends across a different elongated end of each of the individual air chambers. Openings are provided through the one side of the air box underlying the conveyor into the first and second manifold chambers as well. Each of the individual air chambers can be connected with a selected one of the two manifold chambers by the removal of a removable partition between the individual air chamber and the selected manifold chamber. Alternatively, movable partitions or other controllable gates and valves may be provided.

DETAILED DESCRIPTION OF THE INVENTION

The following invention can be incorporated into a draw tape bag line, for example, of the type described in U.S. Pat. No. 4,624,654 Boyd et al, assigned to the assignee of this application and incorporated by reference, or a comparable bag line.

Figure 1:
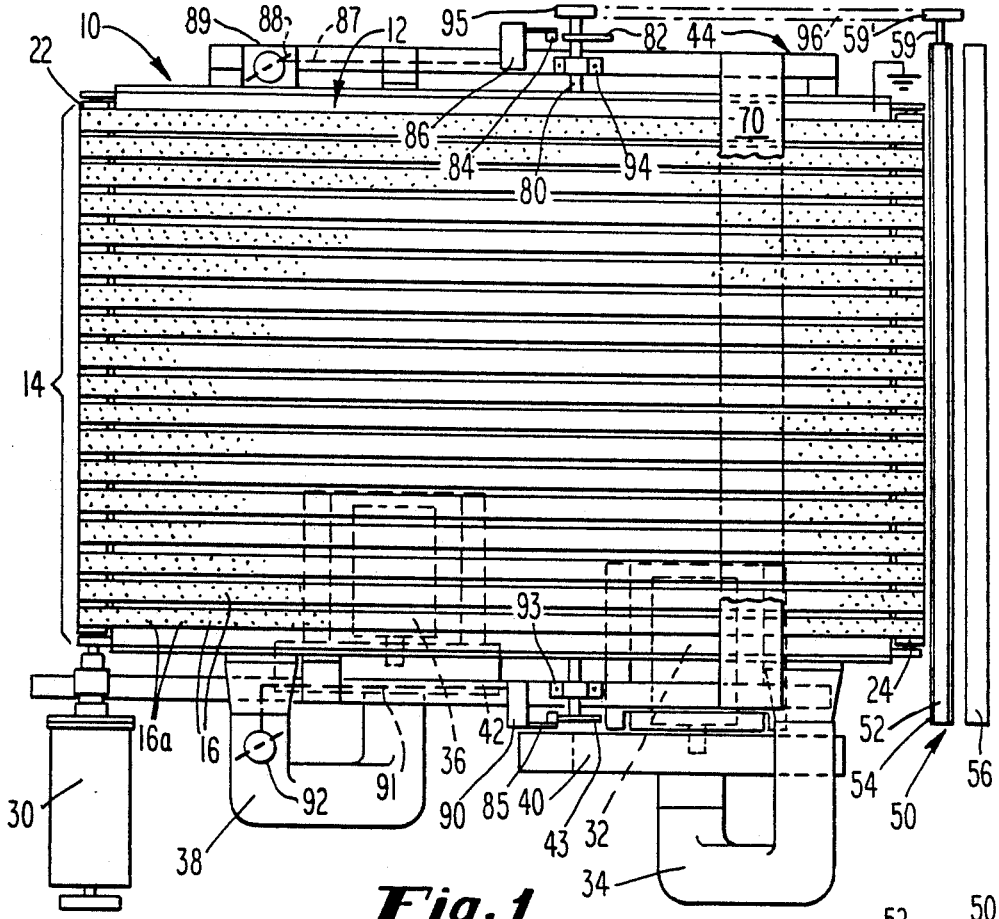
FIG. 1 is a plan view of a plastic film handling apparatus of the subject invention.
Figure 2:
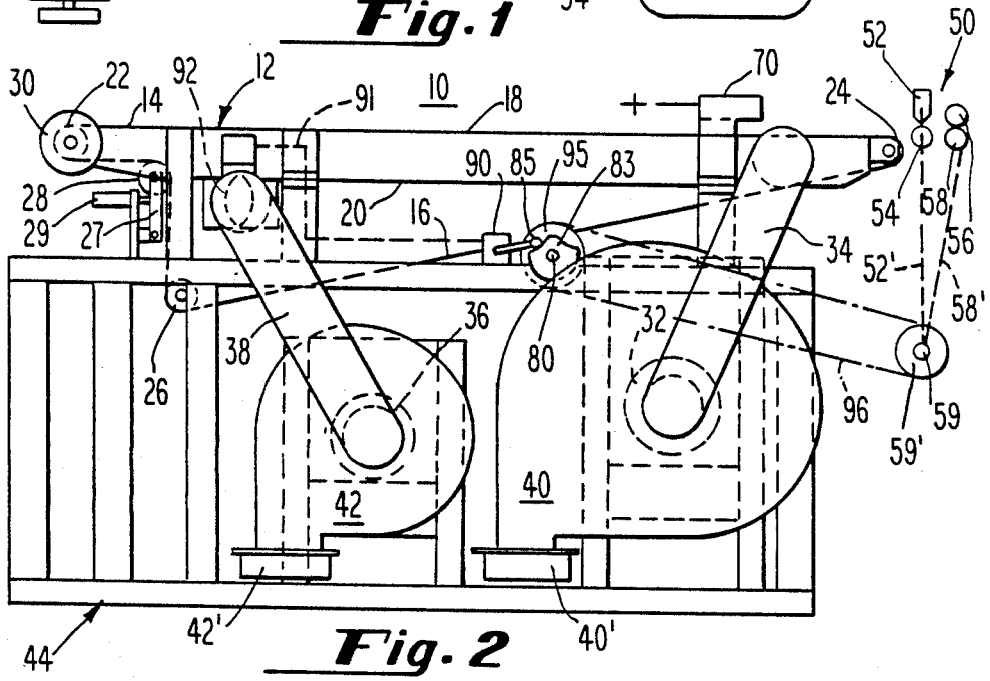
FIG. 2 is a side elevation of the apparatus of FIG. 1.

Referring to FIGS. 1 and 2, the plastic film handling apparatus of the invention is depicted generally by the reference numeral 10. Its major components include an air table or box 12 and, a conveyor indicated generally by reference numeral 14 passing over the box 12 and formed by a plurality of parallel spaced endless belts 16. The belts 16 are guided around upper and lower horizontal sides 18 and 20 (i.e. top and bottom) of the box 12 on rollers 22, 24, 26. A plurality of pivotally supported arms 27 each supports a pulley 28 which is pressed against an individual belt 16 by an air cylinder 29 for adjusting the tension of the belts 16. Roller 22 is coupled with a rotary drive unit 30 which moves the belts 16 of conveyor 14 across the upper horizontal surface 18 from right to left in FIGS. 1 and 2. One end of a first electric exhaust blower 32 is coupled by means of a first plenum 34 to one end of the box 12 One end of a second, electric exhaust blower 36 is coupled by a second plenum 38 to an opposing end of the box 12. Separate, preferably reversibly operable blowers 32 and 36 and separate plenums 34 and 38 are provided for developing different air pressure levels (either negative or positive) at either end of the box 12. It will be appreciated by one of ordinary skill in the art that a single blower might be arranged through proper tubing to develop different negative or different positive air pressure levels simultaneously at either end of the box 12 The rotary drive 30 may be continuous running or indexing. As seen in FIG. 2, each blower 32, 36 is also connected with and supports a second housing 40, 42 respectively each with a muffler filter assembly 40', 42'. A frame 44 supports the box 12, rollers 22, 24 and 26, pulleys 28, rotary drive unit 30 and the pressurizing elements 32, 34, 36 and 38.

The embodiment of the invention being described is particularly suited for conveying plastic film bag bodies from the end of a conventional plastic bag machine, illustrated diagrammatically and identified by the reference numeral 50. The bag machine 50 is positioned adjacent the right hand end of the apparatus 10. The bag machine 50 has been illustrated as equipped with a heated sealing/cutting bar 52 reciprocating against an anvil in the form of a roller 54 for transversely sealing and severing individual plastic film bag bodies in succession from a continuous length of plastic film. Such a bag machine, for example, may be an Amplas Model 1402 or other commercially available bag making machine. A pair of nip rolls 56, 58 index from the bag machine 50 a bag width of material past the bar 52 and roller 54 and onto the leading upper edge of the continuous conveyor 14 at the right hand end of the top surface 18 of the table 12. The sealing/cutting bar 52 reciprocates against the roller 54 to transversely seal and sever the bag body from the continuous length of film and to concurrently make the leading transverse seal in the succeeding bag body. In such applications, it is preferable that the rotary drive unit 30 be indexing and coordinated with the indexing operation of the bag machine 50 by conventional mechanical or electrical means, not shown. An example of a suitable indexing drive unit is disclosed in a related patent application HYDRAULIC INDEX DRIVE SYSTEM, Ser. No. 099,276 filed herewith on Sept. 21, 1987 assigned to the assignee of the present application and incorporated herein by reference.

In a preferred mode of operation, the table 12 is further equipped with a static bar 70 supported over the right hand end of the table near the bag machine 50, which applies a static charge to the thermoplastic film bags fed onto the conveyor 14 from the machine 50. The static bar 70 is a high DC voltage static inducing system which bonds the bags to the belts of the conveyor 14. Also provided is a shaft 80 mounted beneath the table 12 and carrying at either end cams 82 and 83 operating valve levers 84, 85, respectively. In turn, valve lever 84 operates a valve 86 connected by a pneumatic line, indicated by broken line 87, to a butterfly valve 88 mounted in a housing 89 attached to the side of the vacuum table 12 opposite plenum 38. Lever 85 operates a valve 90, coupled by a pneumatic line, indicated by broken line 91, with a second butterfly valve 92 positioned in plenum 38. The shaft 80 is supported in bearing block 93, 94 mounted on horizontal members of the frame 44. The shaft 80 is rotated by means of a pulley 95 coupled by belt 96 with a second pulley 59' fixedly mounted to a main shaft 59 of the conventional bag machine 50. The main shaft 59 may be used to reciprocate the heat seal bar 52 by a conventional linkage indicated diagrammatically by broken line 52' and/or intermittently advance one of the two nip rollers 56, 58, , as indicated diagrammatically by broken line 58'.

Figure 3:
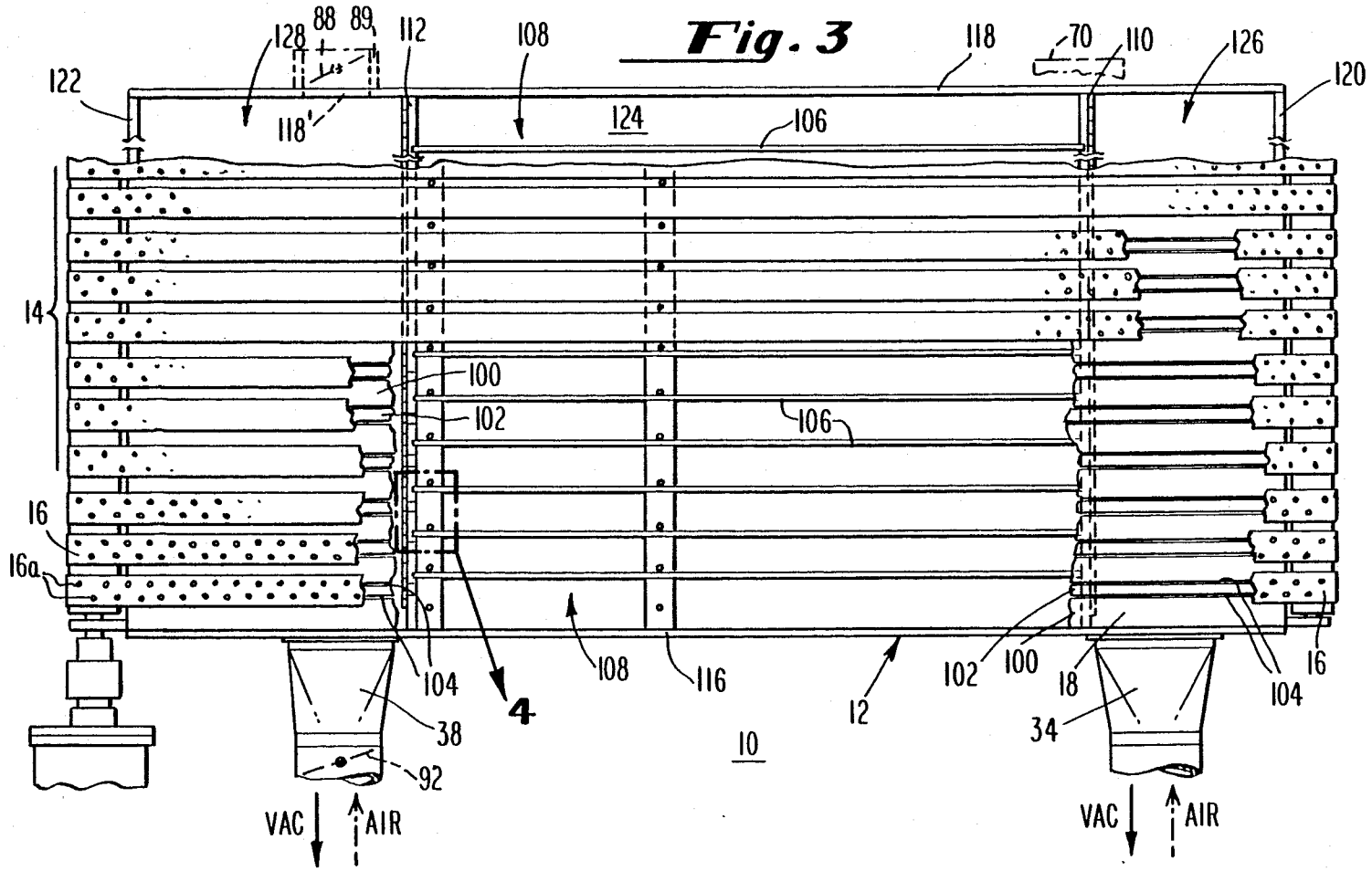
FIG. 3 is a detailed plan view on enlarged scale of the apparatus of FIGS. 1 and 2 partially sectioned in layers showing the individual components thereof.

Referring now to FIG. 3, the construction of the apparatus 10 is further described. The upper horizontal surface 18 is formed by elongated, parallel, alternated aluminum plate members 100 and 102 of wide and narrow widths, respectively. The plate members 100, 102 are also parallel with the running direction of the individual belts 16 of conveyor 14. The alternating aluminum plate members 100, 102 are spaced slightly apart from one another to create elongated slits 104, parallel to the belts 16, through the upper surface 18 into the interior of the box 12. The slits 104 allow an air pressure developed within the box 12 to be applied through the upper surface 18 to the belts 16. The belts 16 are provided with a multiplicity of regularly spaced holes **16*a* which overlie each of the slit openings 104 thereby allowing the air pressure developed through the slit openings 104 to be applied to the plastic film received on the exposed, upper surface of the belts 16. The aluminum plate members 100, 102 span a series of parallel, elongated vertical partitions 106, which extend in a direction parallel to the direction of the belts 16 and between the lower planar surfaces of the plate members 100, 102 and above a bottom wall 124 of the box 12. The partitions 106 form common walls between a plurality of elongated, adjoining, individual, isolated air chambers 108 which extend parallel to the belts 16. A pair of vertical, elongated transverse partitions walls 110 and 112 also spanned by members 100, 102, are notched at regular intervals to receive an end of each partition wall 106 and form an end wall of each chamber 108. In general, the box side walls 116 and 118, the end walls 120 and 122 and the bottom wall 124 complete the air box enclosure 12. The walls 116, 118, 120, 122 and 124** may be integral planar or pieced together from individual elements, depending upon the desires of the builder. Seams between the various walls may be sealed with duct tape, caulk or other conventional means for the materials employed.

As shown in FIG. 3, the end wall 120 of box 12, the internal partition wall 110, and portions of sidewalls 116, 118 and bottom wall 124 of the box 12 and plate members 100, 102 enclose and define a first manifold chamber 126 at the right end of the box 12 spanning all of the parallel elongated vacuum chambers 108 at their right hand end. A second manifold chamber 128 is formed at the left hand end of the box 12 by the internal partition wall 112 and the box end wall 122 and portions of the sidewalls 116 and 118, the bottom wall 124 and plate members 100, 102. Each slit 104 spans both manifold chambers 126, 128 as well as one individual air chamber 108. An end of the plenum 34 coupled with blower 32 is mounted over an opening through the box sidewall wall 116 so as to apply the air pressure developed by the first blower 32 (FIGS. 1 and 2) to the first air manifold chamber 126. An end of the second plenum 38 coupled with blower 34 is also mounted over an opening through the box sidewall 116 to apply a second air pressure developed by the second blower 36 (FIGS. 1 and 2) to the second air manifold chamber 128.

Figure 4:
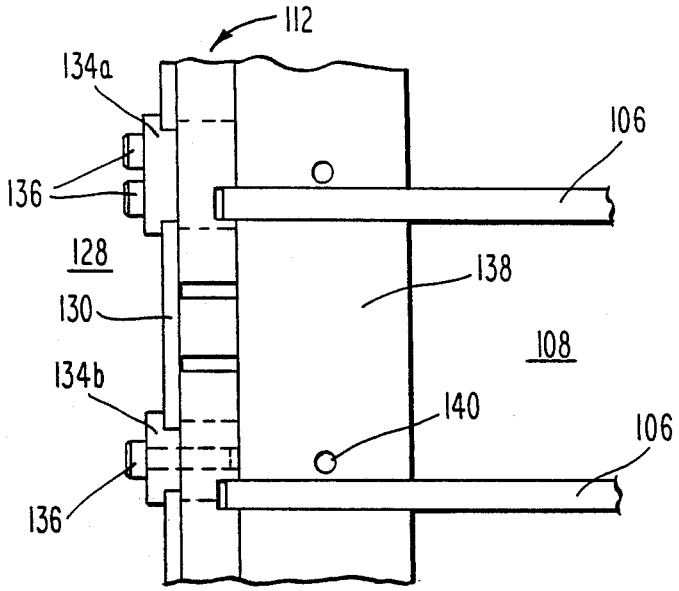
FIG. 4 is an enlarged view of area 4 of FIG. 3 illustrating the removable partition between each individual vacuum chamber and each vacuum manifold chamber.

Mounted in each partition wall 110 and 112 between each manifold chamber 126, 128 and each of the parallel elongated individual air chambers 108 is an air pressure coupling in the form at a removable partition or gate indicated generally at 4 in FIG. 3. As is indicated specifically in FIG. 4, each adjustable gate 130 is held over an opening through the partition wall 112 between the manifold chamber 128 (or 126) and one of the individual chambers 108 by brackets 134*a* and 134*b* and bolts 136. Mounting of identical gates in the other transverse partition wall 110 is identical. Thus, each of the chambers 108 may be decoupled from the air pressure in either of the manifold chambers 126 or, 128 by leaving its gates 130 in place or selectively coupled to a selected one of the manifold chambers 126 or, 128 by removal of the gate 130 between the individual chamber 108 and the selected manifold chamber 126 or, 128.

This design of the air box 12 provides for substantial flexibility in configuring the apparatus 10. For example, both blowers 32 and 36 can be operated to generate the same negative pressure level in the manifold chambers 126 and 128 and all of the gates 130 removed to provide performance comparable to conventional vacuum tables. The gates 130 may be left in place at either end of the chambers 108 which will not underlie the particular plastic film webs being transported, to prevent air pressure loss through those chambers. Moreover, while the manifold chambers 126 and 128 are shown as directly underlying part of the table surface 18, for applying a selective negative or positive air pressure through that surface, the chambers 126 and 128 might be positioned adjoining one another and beneath the elongated, parallel, individual chambers 108. Adjustable or otherwise controllable air pressure couplings could then be provided through the bottom of each chamber 108 between the chamber 108 as each manifold chamber 126, 128. The removable gates 108 are disclosed are a relatively inexpensive, reliable form of settable pressure coupling between the manifold chambers 126, 128 and the plurality of elongated chambers 108. However, other controllable air pressure couplings such as actuatable diaphragm or butterfly valves, rotatable dampers, slip gates or the like may also be satisfactory or even desirable for some applications.

Figure 5:
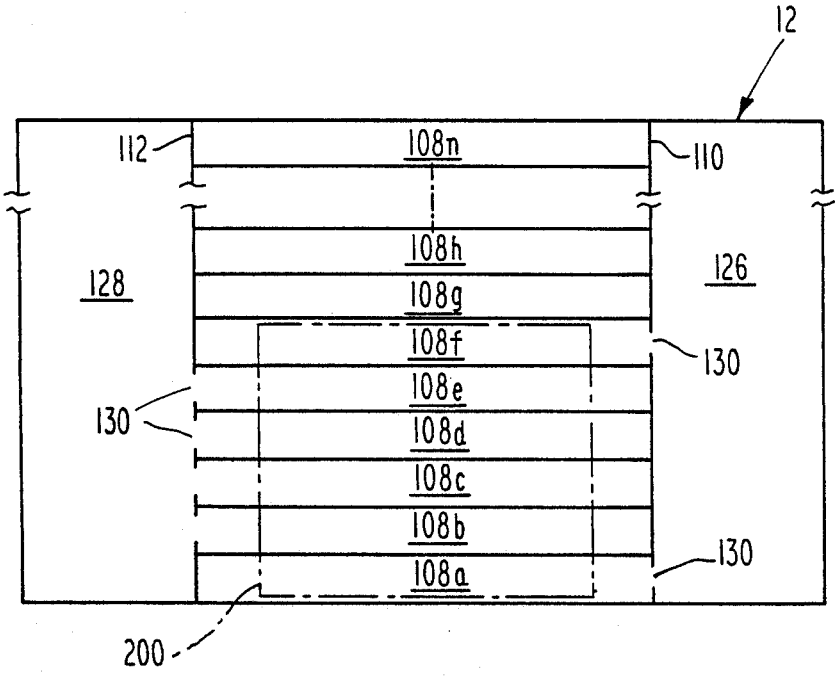
FIG. 5 diagrammatically illustrates a proposed suggested coupling of individual air chambers and the two manifold chambers for movement of a length of plastic film.

FIG. 5 illustrates in diagrammatic form, one suggested configuration of the air table 12 for conveying a plastic bag body 200, indicated in phantom lines. The first vacuum manifold chamber 126 is maintained at a more negative pressure (lower absolute pressure) then the second manifold chamber 128 to apply suction to the portion of the bag body received from the upstream bag machine 50, FIG. 1, and hold the bag taut on the conveyor. The elongated individual chambers 108*a* and 108*f*, underlying the top and bottom edge portions of the bag 200, are also coupled with the first manifold chamber 126 to assure that those edges are held firm against the conveyor passing over the table 12. The intermediate chambers 108*b*–108*e* are coupled with the second vacuum manifold chamber 128 so that less pressure is applied to the major central portion of the bag body 200. This reduces the load on the conveyor. The remaining chambers 108*g*–108*n* are decoupled from both manifold chambers 126, 128 to prevent pressure loss therethrough.

The machine was used in the configuration indicated in FIG. 5 with a fifteen inch water negative air pressure applied in manifold chamber 126 and in individual air chambers 108*a* and 108*f* underlying the edges of a bag while a one-half inch to one inch water negative air pressure was applied to the second manifold chamber 128 and the remaining chambers 108*b*–108*e* underlying the center portion of the bag in combination with a mechanical bag folding mechanism mounted beneath the table 12 and including a plurality of pins extendable through the upper surface 18 and conveyor 14 of the table 12. A suitable bag folding mechanism is disclosed in a related patent application FLEXIBLE MATERIAL FOLDING APPARATUS Ser. No. 099,277 filed herewith on Sept. 21, 1987. That application is assigned to the assignee of the present application and is incorporated by reference. The conveyor 14 and index drive unit 30 center a bag over the pins. The pins crease the bag along its center and raise the center of the bag from the conveyor 14 on surface 18 of the table into a pair of folding belts (not shown) positioned above the pins and above the conveyor 14 of the table 12. It was found that with large bags, approximately 24 inches by 42 inches in area, such bags were not uniformly lifted into the folding belts even with a relatively small negative air pressure in the down stream portion of the table. Accordingly, as shown in FIG. 3, the butterfly valve 88 was added in the housing 89 mounted over an opening 118' in the side wall 118 of the air table 12, opposite plenum 38, to open the manifold chamber 128 to atmosphere. A second butterfly valve 92 positioned in the plenum 38 was also used to pneumatically decouple the chamber 128 from the blower 34. The butterfly valve 88 was closed until just before the pins of the mechanical folder were fired into the bag while the second butterfly valve 92 was open until that time.

In addition to being used to provide two different negative pressure levels, it is to be understood that the apparatus can be configured to provide a negative air pressure and a positive air pressure or different positive air pressures at different areas across the air table surface 18. In a preferred embodiment, the apparatus has been used with a static bar 70 (FIGS. 1–3), spanning the first air manifold chamber 126, FIG. 3, and the plurality of individual chambers 108. In such a configuration, a negative air pressure of approximately 6 inches of water was applied in the first manifold chamber 126 and none of the individual chambers 108 was coupled with the first manifold chamber 126. The individual chambers 108 lying under the plastic bag bodies transported on the belts 16 were coupled with the second manifold chamber 128. A slight positive air pressure, approximately 1½ inch to 1 inch of water was applied in the second manifold chamber 128 and in the individual chambers 108 coupled to the manifold chamber 128. A preferred embodiment of the invention is used to feed bag bodies to a mechanical first fold mechanism, described in the aforesaid related patent application Ser. No. 099,27 filed Sept. 21, 1987. Such a first fold mechanism would be mounted beneath the air table 12 and includes a plurality of pins which are driven upwardly through the upper surface 18 of the table and the conveyor 14 against a plastic bag on the conveyor 14, creasing the bag at its center and lifting the bag at its crease into a pair of folding belts spaced from and above the table 12. When configured for use with such a first fold mechanism for the folding large plastic film bags, a negative pressure of about 6 inches of water was applied to the manifold chamber 126 while a slight positive pressure, approximately 1½ inch to 1 inch of water was applied to the second manifold chamber 128 and to the individual chambers 108 which underlie the bag and which are coupled with the second manifold chamber 128. The negative air pressure in the first chamber 126 is desired for engaging and tensioning a continuous length of plastic film fed from the bag machine 50 before a portion of the continuous web is severed by the heater/sealer bar 52 (FIGS. 1 and 2). A static charge of 15,000–20,000 KV was applied to the bag by the static bar 70 (See FIGS. 1–3) which caused each bag to be attracted to the grounded aluminum plate members 100, 102. When engaged by the pins of the first fold mechanism, the center portion of the bag is lifted from the conveyor 14 of the table 12. The slight, positive air pressure in the individual chambers 108 underlying the bag 200 caused the lifted bag to bubble, preventing the bag from re-adhering to the conveyor surface.

If desired, actuatable valves can be provided in a wall of either or both of the vacuum manifold chambers 126 and 128 to controllably depressurize either or both chambers 126, 128 by opening the chamber 126, 128 to the atmosphere.

While a preferred embodiment of the invention has been described and illustrated, it is to be understood that other modifications may be made without departing from the spirit and scope of the invention as set forth in the appended claims.

What is claimed is:

1. A plastic film handling apparatus comprising:

an air table defining an enclosure having a top surface and a bottom surface, said top surface having a plurality of spaced openings extending therethrough;

conveyor means extending over said openings in said top surface of said air table for moving a length of plastic film across said top surface of said air table;

a plurality of individual air chambers within said air table communicating with said plurality of spaced openings extending through said top surface of said air table;

pressurizing means connected with said air table for applying a first air pressure level less than atmospheric air pressure to only a first selected number of said individual air chambers and to said conveyor means extending over said openings in said top surface of said air table communicating with said first selected number of said individual air chambers to cause a length of plastic film to adhere by suction to said conveyor means;

electrostatic means extending over said conveyor means and positioned adjacent said first selected number of said individual air chambers for applying a static electric charge to the length of plastic film on said conveyor means to cause the length of plastic film to adhere to said conveyor means after the length of plastic film is moved beyond said first selected number of said individual air chambers by said conveyor means;

a plurality of spaced, parallel partitions extending between said first manifold chamber and said second manifold chamber for defining parallel common walls between said plurality of individual air chambers; and a pair of transverse partitions, each partition intersecting an end of each of the plurality of spaced, parallel partitions and defining a common wall between each of said plurality of individual air chambers and one of said first and second manifold chambers.

2. The apparatus of claim 1 wherein said adjustable air pressure coupling means comprises:

a plurality of removable gates in each of said pair of transverse partitions, each gate separating one of said first and second manifold chambers from one of said individual air chambers.

3. The apparatus of claim 2 wherein said top surface of said air table comprises:

a plurality of parallel elongated members, each spanning said pair of transverse partitions and spanning at least part of one of said plurality of individual air chambers, said elongated members being spaced from one and other providing elongated slits across said top surface of said air table constituting said plurality of spaced openings.

4. The apparatus of claim 3 wherein said conveyor means is movable across the one side of the air table in a first direction and a subset of said interconnected partitions extend parallel to the first direction to define common walls between parallel, elongated, individual air chambers.

5. The apparatus of claim 4 further comprising:

a plurality of interconnected partitions extending between said upper side and an opposing side of said air table defining said plurality of individual air chambers.

6. The apparatus of claim 5 wherein said conveyor means is movable across said upper side of said air table in a first direction and said interconnected partitions extend parallel to the first direction to define common walls between said individual air chambers.

7. The apparatus of claim 6 wherein said pressurizing means comprises:

a first manifold chamber extending between said upper side and said opposing side of the air table and across one end of each of the plurality of individual chambers and a plurality of openings extending through said upper side of the air table into said first manifold chamber.

8. The apparatus of claim 7 wherein said pressurizing means comprises:

a plurality of adjustable air pressure coupling means for selectively coupling each of said plurality of individual air chambers with said first manifold chamber.

9. The apparatus of claim 8 wherein said pressurizing means further comprises:

a second manifold chamber extending between said upper side and said opposing side of the air table and across the other end of each of the plurality of individual chambers and a plurality of openings extending through said upper side of the air table into said second air manifold chamber.

10. The apparatus of claim 8 wherein said pressurizing means further comprises:

a plurality of adjustable air pressure coupling means for selectively coupling each of said plurality of individual air chambers with said second manifold chamber.

11. The apparatus of claim 1 wherein said pressurizing means comprises:

a first manifold chamber adjoining each of said plurality of individual air chambers; and a first manifold chamber adjoining each of said plurality of individual air chambers; and a second manifold chamber isolated from said first manifold chamber and adjoining each of said plurality of individual air chambers; and adjustable air pressure coupling means between each individual air chamber and said first manifold chamber and adjustable air pressure coupling means between each of the individual air chambers and said second manifold chamber for selectively coupling each of the plurality of individual air chambers with the air pressure in one of said first and second manifold chambers.

12. The apparatus of claim 11 wherein each of said first and second manifold chambers also adjoins said top surface opposite said conveyor means and at least some of said plurality of spaced openings extend through said top surface into each of said first and second manifold chambers.

13. A method of operating a plastic film handling apparatus comprising the steps of:

placing a length of plastic film on a conveyor and moving the conveyor across a surface;

applying a first air pressure level less than atmospheric air pressure to the length of plastic film through a first portion of the surface and the conveyor to cause the length of plastic film to adhere by suction to the conveyor when passing over the first portion of the surface;

applying a static electric charge to the length of plastic film on the conveyor to cause the length of plastic film to adhere to the conveyor after the length of plastic film is moved beyond the first portion of the surface by the conveyor; and applying a positive air pressure level greater than atmospheric air pressure to the length of plastic film through another portion of the surface spaced from the first portion.

* * * * *